US005194841A

United States Patent [19]

Galloway et al.

[11] Patent Number: 5,194,841

[45] Date of Patent: Mar. 16, 1993

[54] SUPPORT STRUCTURE FOR WOUND TRANSFORMER CORE

[75] Inventors: Dudley L. Galloway; Stanley B. Linsenbardt, both of Jefferson City, Mo.

[73] Assignee: ABB Power T&D Company, Inc., Blue Bell, Pa.

[21] Appl. No.: 629,830

[22] Filed: Dec. 19, 1990

[51] Int. Cl.[5] ..... H01F 27/26; H01F 27/30

[52] U.S. Cl. ..... 336/92; 336/196; 336/210

[58] Field of Search ..... 336/67, 68, 92, 210, 336/197, 196, 65

[56] References Cited

U.S. PATENT DOCUMENTS

| | | | |
|---|---|---|---|
| 1,394,121 | 10/1921 | Sclater | 336/210 |
| 2,543,089 | 2/1951 | Zimsky | 336/210 |
| 2,699,531 | 1/1955 | Massar | 336/92 |
| 2,911,603 | 11/1959 | Harke | 336/210 |
| 3,160,837 | 12/1964 | Jones | 336/67 |
| 3,374,453 | 3/1968 | Broverman et al. | 336/197 |
| 3,662,308 | 5/1972 | Muschong | 336/210 |
| 4,663,605 | 5/1987 | Lee | 336/92 |
| 4,673,907 | 6/1987 | Lee | 336/92 |

FOREIGN PATENT DOCUMENTS

| | | | |
|---|---|---|---|
| 134163 | 2/1979 | Fed. Rep. of Germany | 336/92 |
| 1404921 | 5/1965 | France | 336/210 |
| 946351 | 1/1964 | United Kingdom | 336/210 |

*Primary Examiner*—Thomas J. Kozma

*Attorney, Agent, or Firm*—Ostrolenk, Faber, Gerb & Soffen

[57] ABSTRACT

A cradle or sling of banding strap material supports a wound magnetic core from an upper fixed support to at least partly relieve the weight of the core on the transformer winding and to permit the core to assume a more relaxed shape to reduce its internal stress and thus AW and TW core losses.

29 Claims, 3 Drawing Sheets

SUPPORT STRUCTURE FOR WOUND TRANSFORMER CORE

BACKGROUND OF THE INVENTION

This invention relates to a structure for power or distribution transformers (hereinafter "power transformers") using a wound magnetic core, and more specifically relates to a novel support structure for reducing the internal stress on the core.

It has been found that the no-load or iron loss of a wound transformer core can be minimized by reducing or eliminating mechanical pressure on the bottom legs of the core loops. One way to remove the mechanical pressure is to support the coil with insulating pressure plates along each side of the core loops. If the heights of the pressure plates is sufficiently larger than the leg build ($E_u$) of the core, then the pressure plates will totally support the coil which will, in turn, support the weight of the core structure which drapes over the top of the coil.

The use of a two-piece frame construction using top and bottom channels strapped together over the core and coil assembly is generally limited to the smaller ratings, for example 50 kVA and below. This limitation comes about because of (1) short circuit strength, and (2) weight limitations. Thus, there is a limit to the weight that can be safely supported by the banding straps holding top and bottom channels together. Some manufacturers use a greater number and/or stronger bands to increase the weight capability. Others use a U-frame construction method for higher kVA shell-form designs. This construction greatly enhances the short circuit strength and maximum total weight that can be safely handled.

Iron losses, consisting of both true watt loss "TW" and apparent watt loss "AW" (stored in the magnetic field) can be reduced with the use of pressure plates in a U-frame construction as well as with the two-piece frame construction. If a U-frame construction is used on heavier core-coil assemblies, then it may be necessary to increase the area of the coil insulation that the pressure plates bear upon. Otherwise, mechanical stresses encountered during shipping, handling, and operation of the transformer may crush the insulating margin and cause deterioration or failure of the coil's insulating system. Further, when the coil is supported in a U-frame structure, the wound core will drape over the top of coil and cause added pressure on the coil and internal stress in the core, thus risking further damage to the coil and increased core loss.

BRIEF SUMMARY OF THE INVENTION

In accordance with the invention, a novel support structure for a wound core transformer uses a U-frame construction with pressure plates and minimizes the TW and AW losses of the core by limiting the amount of core weight that is supported by the coil. Novel banding straps are supported by the U-frame to form a "cradle" around the bottom portion of the U-frame to support the core from an overhead support and reduce the core weight supported by the coil, and to reduce the drape of the core over the tops of the coil.

The objects, advantages, and features of the present invention will be better understood when considered in connection with the appended drawings in which:

DETAILED DESCRIPTION OF THE DRAWINGS

Figure 1:
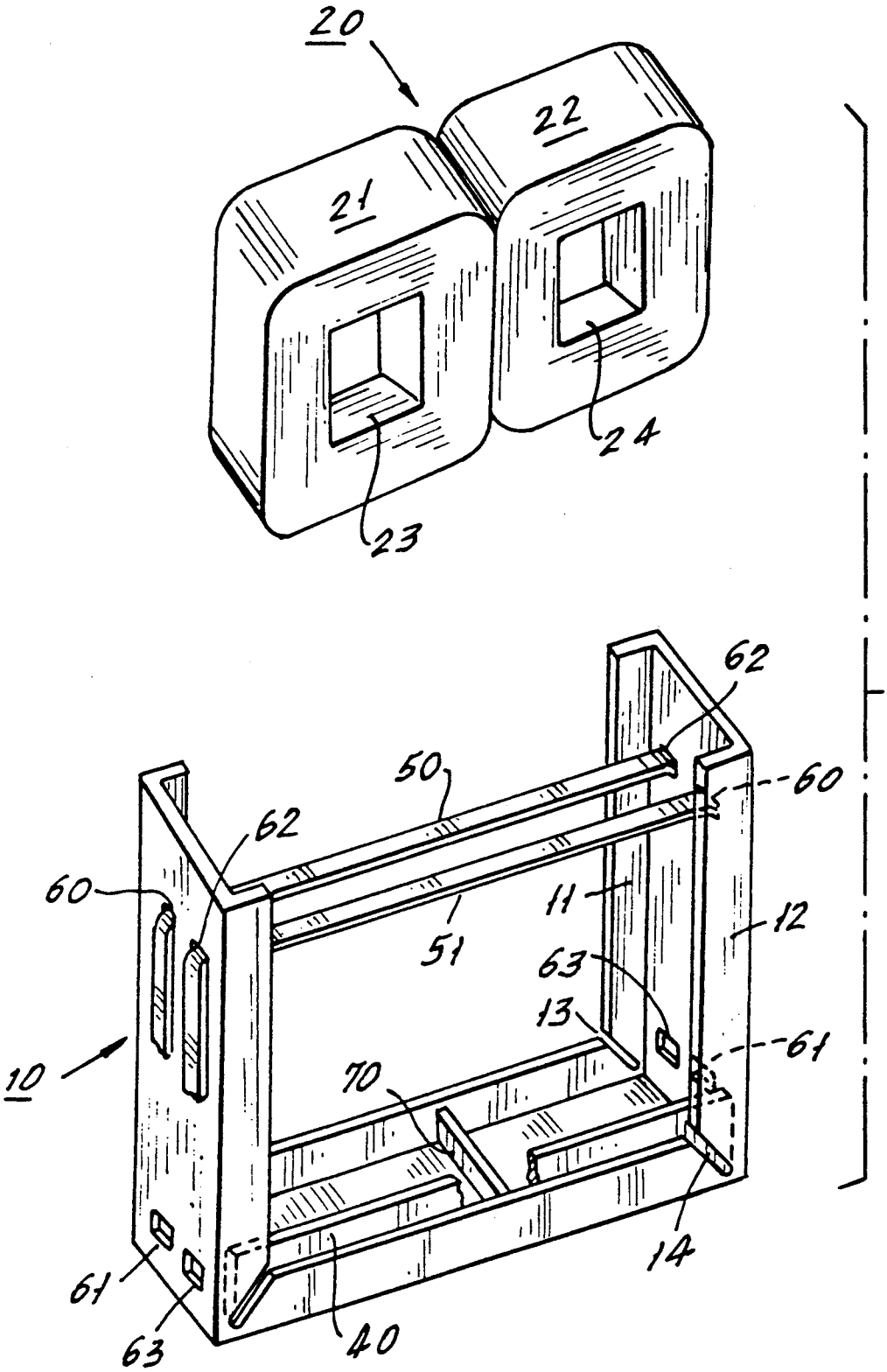
FIG. 1 is an exploded perspective view of the U-frame support and the wound core partially showing the pressure plates and novel cradle straps for the core.

FIGS. 1 to 4 show a first embodiment of the invention for the novel support of a wound magnetic core and its coil in such a way as to reduce the mechanical stress on both core and coil and to reduce the core loss of the wound core. A U-frame support consists of the steel frame member 10 having inwardly bent flanges 11 and 12 extending along its full length. Flanges 11 and 12 may have a height of about 1.5 inches. U-shaped notches such as notches 13 and 14 (FIGS. 1 and 2) permit the frame to be bent to its U-shape. The open top of the U-frame is secured by cross braces 15 and 16 which are bolted to the opposite ends of flanges 12 and 11, respectively.

A wound magnetic core 20 consists of two coils 21 and 22 of a magnetic material strip which are abutted side by side and have openings 23 and 24, respectively, best seen in FIG. 1. A transformer winding 30 (FIGS. 2, 3 and 4) extends through openings 23 and 24 and around the transformer core leg defined between openings 23 and 24.

Figure 4:
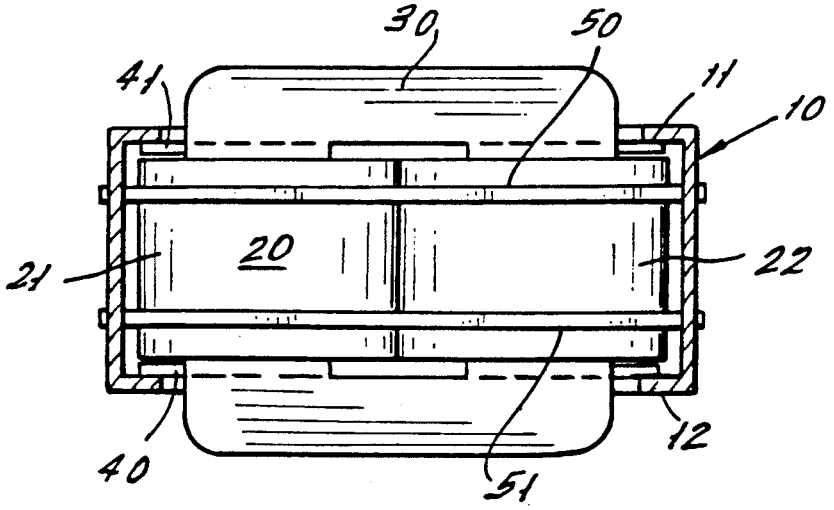
FIG. 4 is a cross-sectional view of FIG. 2 taken across the section line 4—4 in FIG. 2.
Figure 2:
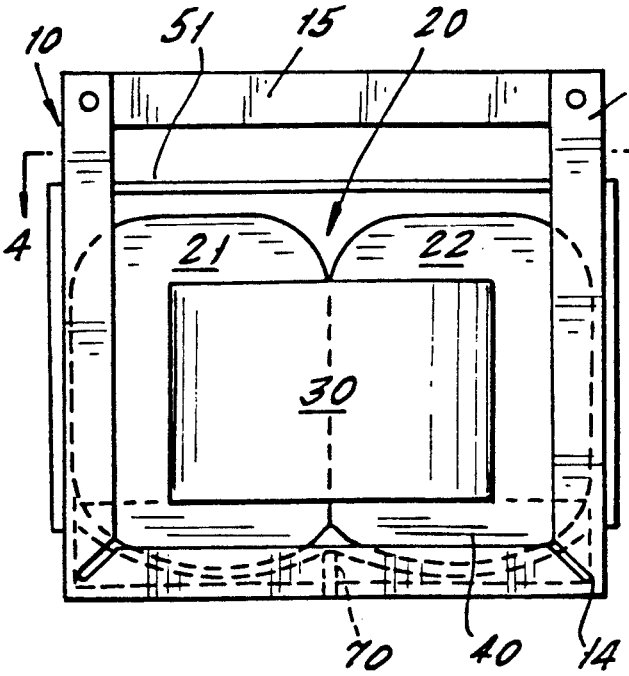
FIG. 2 is an elevation view of the U-frame supported transformer of the present invention.
Figure 3:
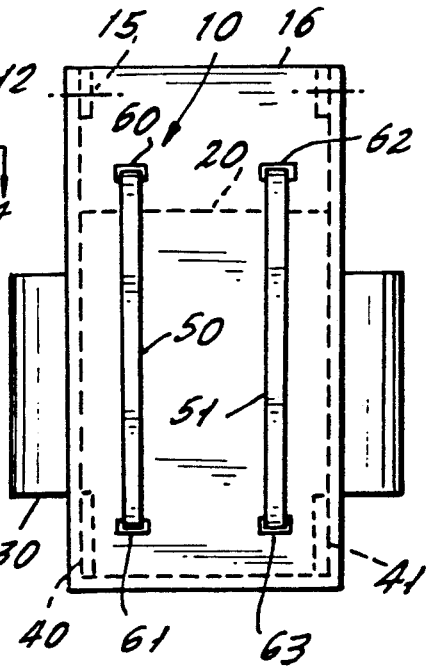
FIG. 3 is a side view of the transformer of FIG. 2.

The core 20 and coil 21 are mounted within frame 10 as shown in FIGS. 2, 3 and 4. Thus, two pressure plates 40 and 41 are fixed within and to flanges 12 and 11 respectively and have a height suitable to engage the bottom of coil 30 and to hold it at a height at which the bottom of coil 30 is pressed upwardly. Thus, the weight of coil 30 is at least partly removed from the bottom of core members 21 and 22. By raising or supporting coil 30 in this manner, the tops of core members 23 and 24 press on and are supported over or drape over the top of coil 30. This applies stress to both the coil 30 and the wound cores 21 and 22. Moreover, the drape of cores 21 and 22 introduces mechanical stress in cores 21 and 22 which increases both TW and AW core losses.

In accordance with the invention, a novel cradle or sling is formed to at least partially support core 20 independently of the coil 30. This relieves the pressure on the top of coil 30 due to the weight of the core 20 and relieves the drape of the core 20 over the top of coil 30 and at its bottom. Thus, mechanical stress within core 20 is reduced, thereby reducing core loss, and the coil 30 is protected against damage due to the weight of core 20.

In a preferred embodiment of the invention, the novel cradle or sling consists of a pair of steel banding straps 50 and 51. Straps 50 and 51 may each have a cross-section of 0.020 inch by 0.5 inch. Straps 50 and 51 extend through windows in the upstanding sides of frame 10 such as windows 60, 61, 62 and 63 for straps 50 (FIGS.

1 and 3) and windows 62, 63 and two others (not shown) for strap 51. Straps 50 and 51 run over the top of core 20, over the outside surface of frame 10 and under the core 20 to apply an upward lifting force thereto. The bands are spaced from and do not press down on the top of core 20.

Since the bands tend to press the core loops inwardly at the core bottom, a center support 70 (FIGS. 1 and 2) about 1.0 inch high is fixed to the bottom of frame 10 so that the cores 21 and 22 are supported symmetrically. This height is not critical and is coordinated appropriately with the other dimensions of the structure.

To install the mounting straps 50 and 51, a conventional banding tool can be used in which the bands can be drawn as tight as desired and then fixed in position. The tension applied to the banding straps 50 and 51 is preferably the tension needed to barely lift cores 21 and 22. The stress on the core material will then be minimized at the bottom and top of the loops.

In carrying out the embodiment of the invention of FIGS. 1 to 4, a transformer was made having a rating of 50 kVA which was oil cooled and had a weight of about 400 pounds. The core weight was about 250 pounds. The frame 10 had a height of about 16 inches, a width of about 16 inches and a depth of about 8 inches. The pressure plates 40 and 41 were made of a wood fiber (Masonite) about 0.25 inch thick and about 0.5 inch higher than the height ($E_u$) of the legs of cores 21 and 22 at their bottom. The tension on bands 50 and 51 was then increased until the cores 21 and 22 barely lifted away from the bottom of frame 10.

Figure 5:
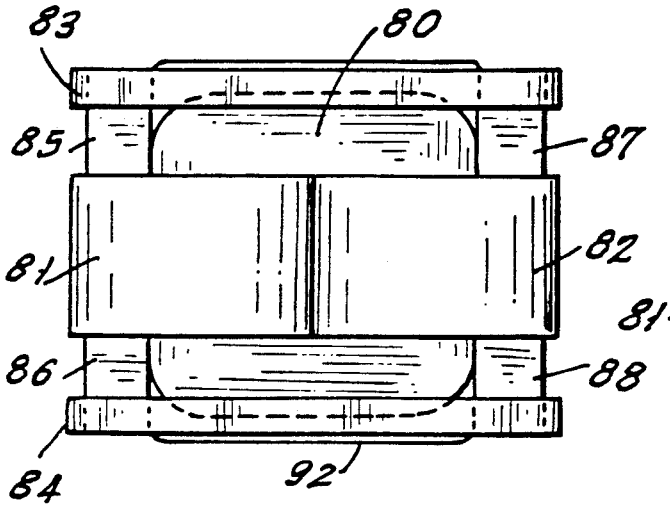
FIG. 5 shows an elevation view of a second embodiment of the invention for a core-form transformer structure.
Figure 6:
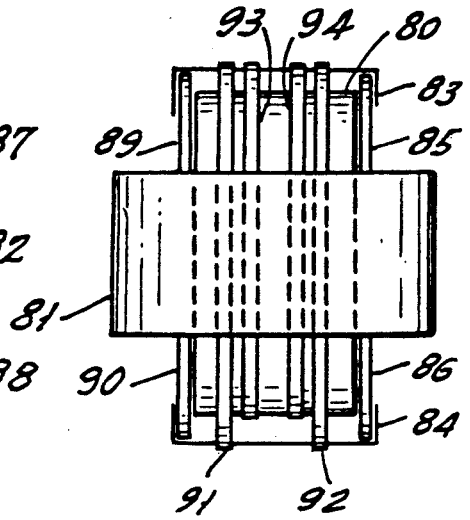
FIG. 6 is a side view of the transformer of FIG. 4.

The novel invention can also be used for core-form transformer designs to limit the core weight supported by the coil, as shown in FIGS. 5 and 6. In FIGS. 5 and 6, there is a donut shaped, wound magnetic core 80, the legs of which receive first and second windings or coils 81 and 82. The core and windings are supported by the schematically shown top and bottom frame members 83 and 84, respectively. Pressure plates 85, 86, 87 and 88 are disposed in one plane and a set of other plates, including plates 89 and 90 (FIG. 6), are disposed in a spaced parallel plane. Each of the pressure plates is pressed between either the top or bottom frame 83 or 84, respectively, and the top or bottom, respectively, of coils 81 and 82 by assembly bands 91 and 92. Bands 91 and 92 extend through openings in frames 83 and 84 and down the vertical sides of core 80. With this structure, the weight of the core 80 is supported on the top of coils 81 and 82.

In accordance with the invention, core support bands 93 and 94 (FIG. 6) extend through suitable openings in upper frame 83 and around the sides and bottom of core 80. Bands 93 and 94 are tightened until core 80 is just barely lifted at its bottom. This then relieves the stress on the tops of coils 81 and 82 and the stress within core 80, thereby reducing core loss.

Figure 7:
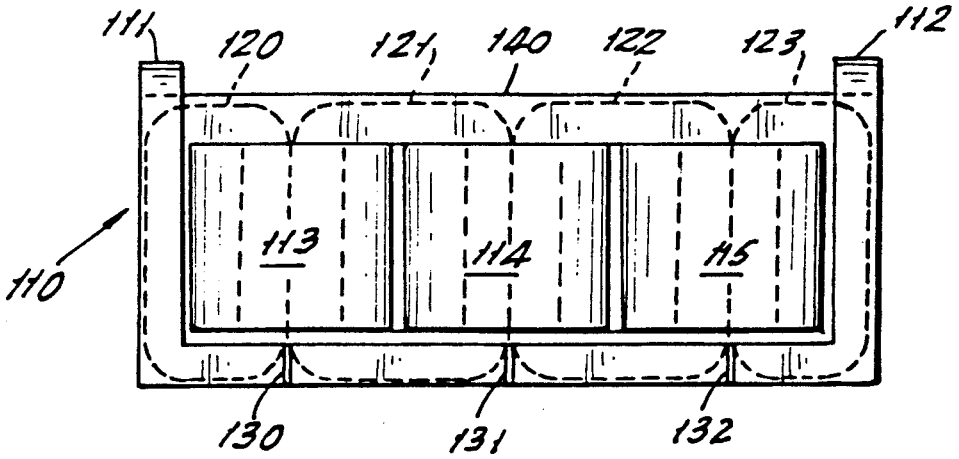
FIG. 7 shows an elevation view of a third embodiment of the invention for a three-phase transformer.

The invention is also applicable to the three phase equivalent of the U-frame supported transformer as shown in FIG. 7. Thus, in FIG. 7, the U-frame is schematically shown as the U-frame 110 having upstanding legs 111 and 112. Three identical windings 113, 114 and 115 extend through appropriate windows of wound magnetic cores 120, 121, 122 and 123. In most respects the transformer of FIG. 7 has the same type of support as was described in FIGS. 1 to 4 for the core 20. The bottom of frame 110 receives shims 130, 131 and 132 centered on coils 113, 114 and 115, respectively, each having the function of shim 70 of FIG. 1. Finally, a pair of core support bands similar to bands 50 and 51 in FIGS. 1 to 4 extend through frame sections 111 and 112 and under the cores 120 to 123 and then across, but spaced from the tops of the cores. FIG. 7 schematically shows one of these encircling bands 140 which tends to lift at least a part of the weight of each of cores 120 to 124 off of the underlying coils 113, 114 and 115, and to relieve the internal stress of the cores due to their drape over the underlying coils, the desired purpose of the invention.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A support structure for and including a power transformer; said power transformer comprising, at least one ring-shaped magnetic core having at least one elongated leg portion for receiving at least one transformer coil; a transformer coil structure encircling said at least one elongated leg portion of said at least one magnetic core; a support frame for supporting said magnetic core and said transformer coil; said support frame having a horizontal section and having first and second vertically upstanding sections disposed in a common plane and extending from the ends of said horizontal section; said at least one magnetic core being disposed between said vertically extending sections in said support frame, the axis of said at least one core being generally perpendicular to said plane of said support frame; at least one pressure plate extending from said horizontal section of said support frame and engaging the bottom of said transformer coil and supporting said transformer coil away from the bottom interior surface of said at least one ring shaped magnetic core, thereby to reduce internal stress in said magnetic core due to the weight of said transformer coil; the improvement which comprises at least one elongated flexible banding strap which is fixed relative to respective upper portions of said first and second vertically extending sections and which extends under the bottom of said at least one magnetic core with a sufficient tension to at least partly support the weight of said at least one magnetic core and to remove at least a portion of the weight of said at least one magnetic core from the top of said transformer coil.

2. The support structure of claim 1 wherein said at least one magnetic core is a wound strip and is non-rigid in a radial direction perpendicular to its axis, whereby said at least one pressure plate reduces the mechanical stress on said at least one core due to the weight of said coil, and whereby said at least one elongated flexible banding strap relieves the stress due to the weight of said at least one core which drapes over the top of said transformer coil.

3. The support structure of claim 2 which further includes a short height vertical stand fixed to said horizontal section and extending parallel to the axis of said at least one magnetic core and pressing against the bottom of said at least one core, with the bottom of said core draped across said vertical stand.

4. The support structure of claim 1 wherein said at least one pressure plate comprises two pressure plates symmetrically disposed on and engaging and supporting opposite sides of said at least one transformer coil.

5. The support structure of claim 1 wherein said at least one banding strap comprises first and second spaced parallel banding straps which symmetrically engage and wrap around the bottom portion of said at least one magnetic core.

6. The support structure of claim 2 wherein said at least one pressure plate comprises two parallel pressure plates symmetrically disposed on and engaging and supporting opposite sides of said at least one transformer coil.

7. The support structure of claim 6 which further includes a short height vertical stand fixed to said horizontal section and extending parallel to the axis of said at least one magnetic core and pressing against the bottom of said at least one core, with the bottom of said core draped across said vertical stand.

8. The support structure of claim 4 wherein said at least one banding strap comprises first and second spaced parallel banding straps which symmetrically engage and wrap around the bottom portion of said at least one magnetic core.

9. The support structure of claim 8 which further includes a short height vertical stand fixed to said horizontal section and extending parallel to the axis of said at least one magnetic core and pressing against the bottom of said at least one core, with the bottom of said core draped across said vertical stand.

10. The support structure of claim 2 wherein said at least one banding strap comprises first and second spaced parallel banding straps which symmetrically engage and wrap around the bottom portion of said at least on magnetic core.

11. The support structure of claim 2 wherein said first and second vertically extending sections have opening means therethrough at a height greater than the uppermost height of said at least one magnetic core; said at least one banding strap having portions thereof which extend through said opening means over the top of said at least one magnetic core.

12. The support structure of claim 11 wherein said at least one banding strap comprises first and second spaced parallel banding straps which symmetrically engage and wrap around the bottom portion of said at least one magnetic core.

13. The support structure of claim 11 which further includes tension means for fixing the tension in said at least one banding strap.

14. The support structure of claim 5 wherein said first and second vertically extending sections have openings therethrough at a height greater than the uppermost height of said at least one magnetic core; said first and second banding straps extending through respective ones of said openings and over the top of said at least one magnetic core.

15. The support structure of claim 14 wherein said at least one pressure plate comprises two pressure plates symmetrically disposed on and engaging and supporting opposite sides of said at least one transformer coil.

16. The support structure of claim 14 wherein said at least one magnetic core is a wound strip and is non-rigid in a radial direction perpendicular to its axis, whereby said at least one pressure plate reduces the mechanical stress on said at least one core due to the weight of said coil, and whereby said at least one elongated flexible banding strap relieves the stress due to the weight of said at least one core which drapes over the top of said transformer coil.

17. The support structure of claim 15 wherein said at least one magnetic core is a wound strip and is non-rigid in a radial direction perpendicular to its axis, whereby said at least one pressure plate reduces the mechanical stress on said at least one core due to the weight of said coil, and whereby said at least one elongated flexible banding strap relieves the stress due to the weight of said at least one core which drapes over the top of said transformer coil.

18. The support structure of claim 16 wherein said first and second vertically extending sections have opening means therethrough at a height greater than the uppermost height of said at least one magnetic core; said at least one banding strap having portions thereof which extend through said opening means over the top of said at least one magnetic core.

19. The support structure of claim 1 wherein said at least one elongated portion of said core comprises first and second parallel vertical sections, and wherein said at least one transformer coil comprises first and second coils disposed on said first and second parallel vertical core sections respectively.

20. The support structure of claim 19 which further includes a short height vertical stand fixed to said horizontal section and extending parallel to the axis of said at least one magnetic core and pressing against the bottom of said at least one core, with the bottom of said core draped across said vertical stand.

21. The support structure of claim 4 wherein said at least one elongated portion of said core comprises first and second parallel vertical sections, and wherein said at least one transformer coil comprises first and second coils disposed on said first and second parallel vertical core sections, respectively.

22. The support structure of claim 5 wherein said at least one elongated portion of said core comprises first and second parallel vertical sections, and wherein said at least one transformer coil comprises first and second coils disposed on said first and second parallel vertical core sections, respectively.

23. The support structure of claim 22 wherein said first and second vertically extending sections have openings therethrough at a height greater than the uppermost height of said at least one magnetic core; said first and second banding straps extending through respective ones of said openings and over the top of said at least one magnetic core.

24. The support structure of claim 2 wherein said at least one magnetic core comprises a plurality of separate cores disposed in a line and wherein said at least one transformer coil comprises a plurality of separate transformer coils disposed in a line and encircling respective pairs of adjacent legs of said plurality of cores to define a multiphase core form transformer structure.

25. The support structure of claim 24 wherein said at least one pressure plate comprises two pressure plates symmetrically disposed on and engaging and supporting opposite sides of said at least one transformer coil.

26. The support structure of claim 24 wherein said at least one banding strap comprises first and second spaced parallel banding straps which symmetrically engage and wrap around the bottom portion of said at least one magnetic core.

27. The support structure of claim 1 wherein said at least one magnetic core comprises a plurality of separate cores disposed in a line and wherein said at least on transformer coil comprises a plurality of separate transformer coils disposed in a line and encircling respective pairs of adjacent legs of said plurality of cores to define a multiphase core form transformer structure.

28. A support structure for supporting and including a flexible strip-wound magnetic core and a winding assembly thereon; said core having vertically extending leg sections joined by top and bottom sections and having a winding axis disposed horizontally; said winding assembly encircling one of said vertically extending leg portions of said core; said support structure comprising a base, a first support means for supporting said winding assembly from said base and out of substantial contact with said bottom section of said core and an overhead second support means disposed beneath and extending around a portion of the outer periphery of the bottom of said core to support at least a portion of the weight of said core which drapes over the top of said winding assembly and to relieve the stress within said core due to said drape.

29. The structure of claim 28 wherein said second support means consists of flexible banding straps which extend from a fixed overhead location and under said bottom section of said core.

* * * * *